US006264048B1

(12) United States Patent
Ramnialis et al.

(10) Patent No.: US 6,264,048 B1
(45) Date of Patent: Jul. 24, 2001

(54) ELECTRIC CABLE COUPLING FOR RAIL-BORNE VEHICLES

(75) Inventors: Christos Ramnialis, Hildesheim; Robert Ehmke, Braunschweig, both of (DE)

(73) Assignee: Scharfenbergkupplung GmbH & Co. KG (DE)

( * ) Notice: Subject to any disclaimer, the term of this patent is extended or adjusted under 35 U.S.C. 154(b) by 0 days.

(21) Appl. No.: 09/383,422

(22) Filed: Aug. 27, 1999

(30) Foreign Application Priority Data

Aug. 28, 1998 (DE) ..... 198 39 320

(51) Int. Cl.[7] ..... B61G 5/06; B61G 1/00

(52) U.S. Cl. ..... 213/1.3; 213/75 R

(58) Field of Search ..... 213/1.3, 1.6, 75, 213/77

(56) References Cited

U.S. PATENT DOCUMENTS

| | | | | |
|---|---|---|---|---|
| 3,842,987 | * | 10/1974 | Prada | 213/1.3 |
| 4,284,311 | * | 8/1981 | Forster et al. | 213/1.3 |
| 4,403,705 | | 9/1983 | Ernst et al. . | |
| 5,139,158 | * | 8/1992 | Lindner et al. | 213/1.6 |

* cited by examiner

*Primary Examiner*—S. Joseph Morano
*Assistant Examiner*—Robert J. McCarry, Jr.
(74) *Attorney, Agent, or Firm*—McGlew and Tuttle, P.C.

(57) ABSTRACT

An electric cable coupling for rail-borne vehicles is held longitudinally displaceably on a central buffer coupling. The cable coupling has only one adapter box (1) as a replacement for the two usual cable coupling halves, wherein the connection lines (4) for the functionally correct connection of the connection lines (2) to the rail-borne vehicles in the correct left-right configuration are arranged crossed within the adapter box (1), and the connection of the connection lines (2) to the two rail-borne vehicles to be coupled is performed via confusion-proof plug-and-socket connections (3) or fixed cables with at least one plug-and-socket connection (3) each.

18 Claims, 4 Drawing Sheets

ELECTRIC CABLE COUPLING FOR RAIL-BORNE VEHICLES

FIELD OF THE INVENTION

The present invention pertains to an electric cable coupling for rail-borne vehicles, which is held longitudinally displaceably on a mechanical central buffer coupling.

BACKGROUND OF THE INVENTION

Such a cable coupling has been known from, e.g., DE 29 22 439 A1. The cable coupling is arranged and guided on a support under the tight coupling. The mechanical central buffer coupling is designed as a tight coupling to be connected manually, the two coupling halves of which are connected by a coupling sleeve. On the support, which comprises two support plates, which are arranged at right angles to the coupling axis and are arranged to the left and right of the coupling rod and are connected by two tie rods, mounting holes are provided in the support plates for the longitudinally displaceable mounting of guide bars. Furthermore, centering members are provided on the support places for the accurate flush alignment of the ends of the two coupling rods. The ends of the coupling rods have beads, which are surrounded by the coupling sleeve in a nonpositive and positive-locking manner. The half of the cable coupling that is assigned to each coupling rod is held by springs in its uncoupled position located behind the front surface of the mechanical coupling half and can be pushed forward into the coupled position for coupling.

It should be borne in mind in connection with the coupling of the electrical cable coupling that only the contacts on the vertical central longitudinal plane are always coupled in a correctly functioning manner and in a correct left-right configuration without additional measures. Contacts of the cable coupling of a vehicle end that are arranged to the left and right of this plane are usually on the opposite side at the end of the adjacent vehicle to be coupled. This problem was solved, e.g., by making the contacts redundant, i.e., contacts configured for the same functions are arranged mirror symmetrically on both sides to the left and right of the ventral central longitudinal plane. Small, lightweight couplings, which can be connected and uncoupled rapidly and simply, are desirable for cable couplings that are used for tight couplings to be connected manually. However, the reduction of the weight and the overall size strongly depends on the number of contacts to be accommodated in the contact support. The current expense for two complete, longitudinally displaceable cable coupling halves does not seem to be justified, either, if the advantage in terms of saving manpower and time is not given here compared with the actuation of fully automatic central buffer couplings in the case of tight couplings that can be operated only manually.

A similar cable coupling is also known from DE 41 34 327 A1, which has the same drawbacks.

SUMMARY AND OBJECTS OF THE INVENTION

The primary object of the present invention is to improve a cable coupling of this class for rail-borne vehicles such that the redundant contact arrangement arranged symmetrically to the vertical central longitudinal plane of the coupling rod is avoidable and the cable coupling as a whole can be made simpler and lighter.

According to the invention, an electric cable coupling for rail-borne vehicles is provided, which is held longitudinally displaceably on a mechanical central buffer coupling. The cable coupling has a compact, longitudinally displaceable adapter box. The adapter box contains the necessary electric connection lines for connecting the connection lines of the rail-borne vehicles to be coupled. These connection lines are for connecting the connection lines with the rail-borne vehicles in a functionally correct manner and in a correct left-right configuration and are arranged crossed within the adapter box such that the connection line, which is arranged to the left of the vertical central longitudinal plane of the central buffer coupling and is associated with one end of the said adapter box is arranged mirror symmetrically to the right of the vertical central longitudinal plane at the opposite end of the adapter box. The connection line arranged to the right of the vertical central longitudinal plane is arranged correspondingly on the left at the other end of the adapter box. The connection of the connection lines from the adapter box to the two rail-borne vehicles to be coupled is performed by means of confusion-proof plug-and-socket connections or fixed cables with at least one such plug-and-socket connection each.

The advantage of the cable coupling according to the present invention over the state of the art lies, in particular, in that only one, compact adapter box is sufficient for electrically coupling two vehicles instead of two, longitudinally displaceable cable coupling halves. Due to the adapter box containing components, especially connection lines, which are arranged and associated within the adapter box such that the connection lines are connected to the two rail-borne vehicles to be coupled in the correct left-right configuration and in a correctly functioning manner, the double arrangement of the contact arrangement that is otherwise necessary is avoidable.

Due to the two-part design of the longitudinal guide on both sides of the point of separation of the coupling, both an optional, axial longitudinal displacement of the adapter box on both sides of the point of separation of the coupling and a central arrangement under, above or optionally in the plane of the point of separation of the central buffer coupling is possible.

By providing a locking means in the area of the point of separation of the coupling, reliable positioning of the adapter box during operation is ensured, while the locking means for securing the displaced position makes possible the shunting of the vehicle without the adapter box being able to accidentally slide off from the longitudinal guide and be possibly damaged while being dragged along. Due to the provision of a gap between the two parts of the linear guide in the coupling plane, damage to the longitudinal guide during the bringing together of the coupling halves of the mechanical coupling is avoided with certainty.

For repair purposes, and especially when an adapter box is arranged on the two coupling halves of the mechanical coupling that are to be coupled, it is advantageous for one of the two being able to be completely removed from the longitudinal guide.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
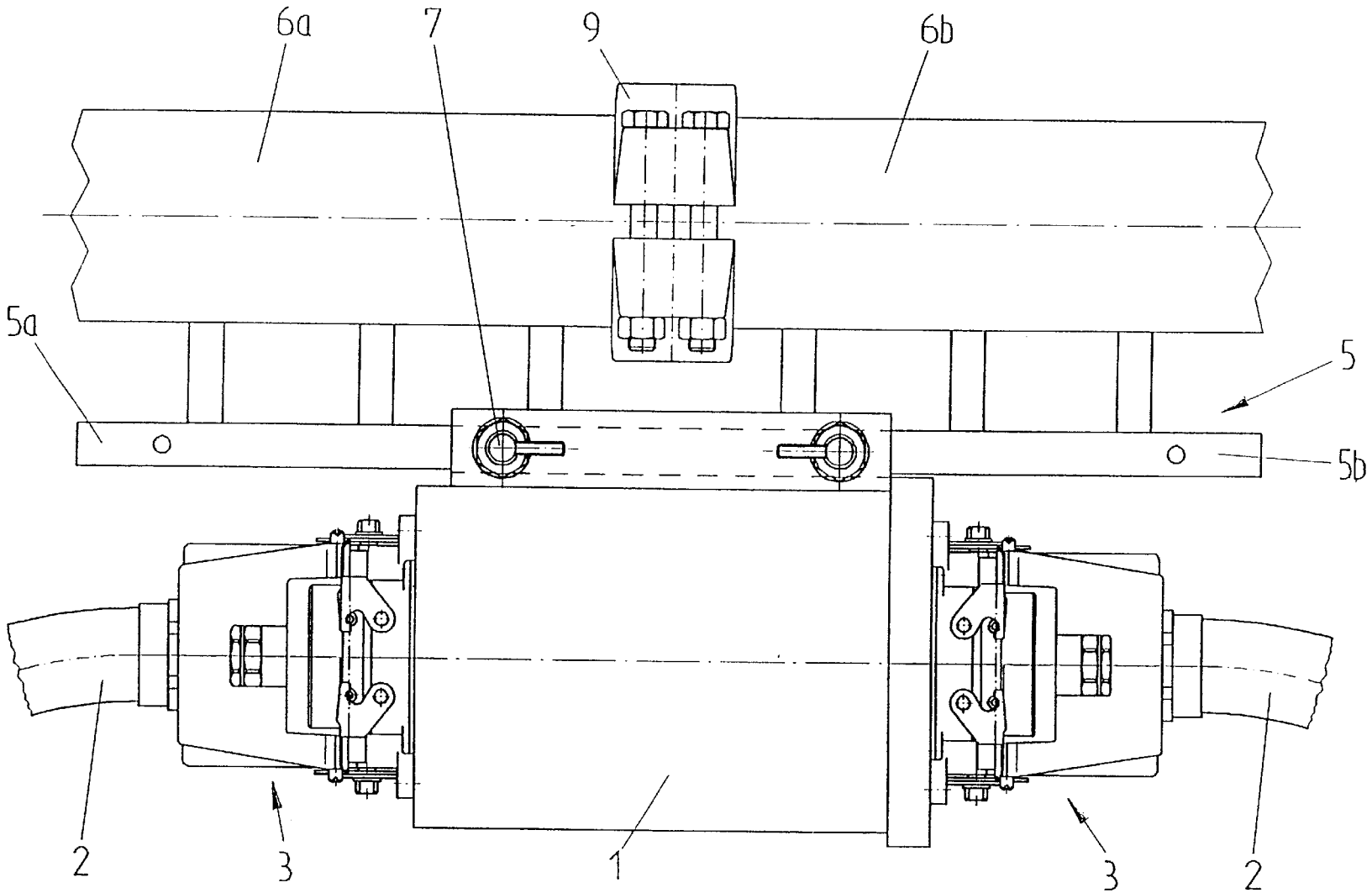
FIG. 1 is a side view of a cable coupling according to the present invention with the central buffer coupling coupled and with the adapter box arranged under the point of separation of the coupling.
Figure 2:
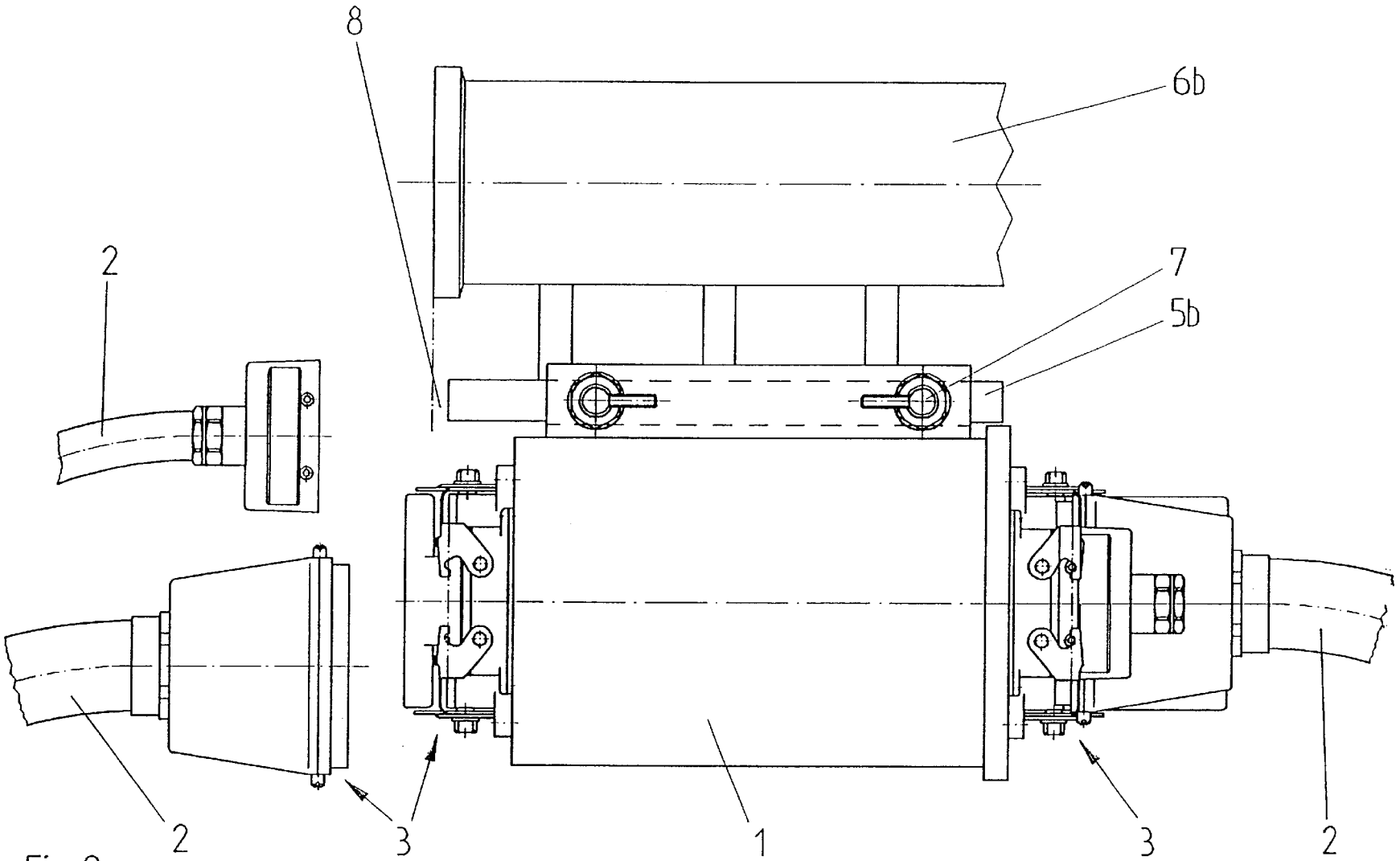
FIG. 2 is a side view of the adapter box in a displaced position with the associated mechanical central buffer coupling.
Figure 3:
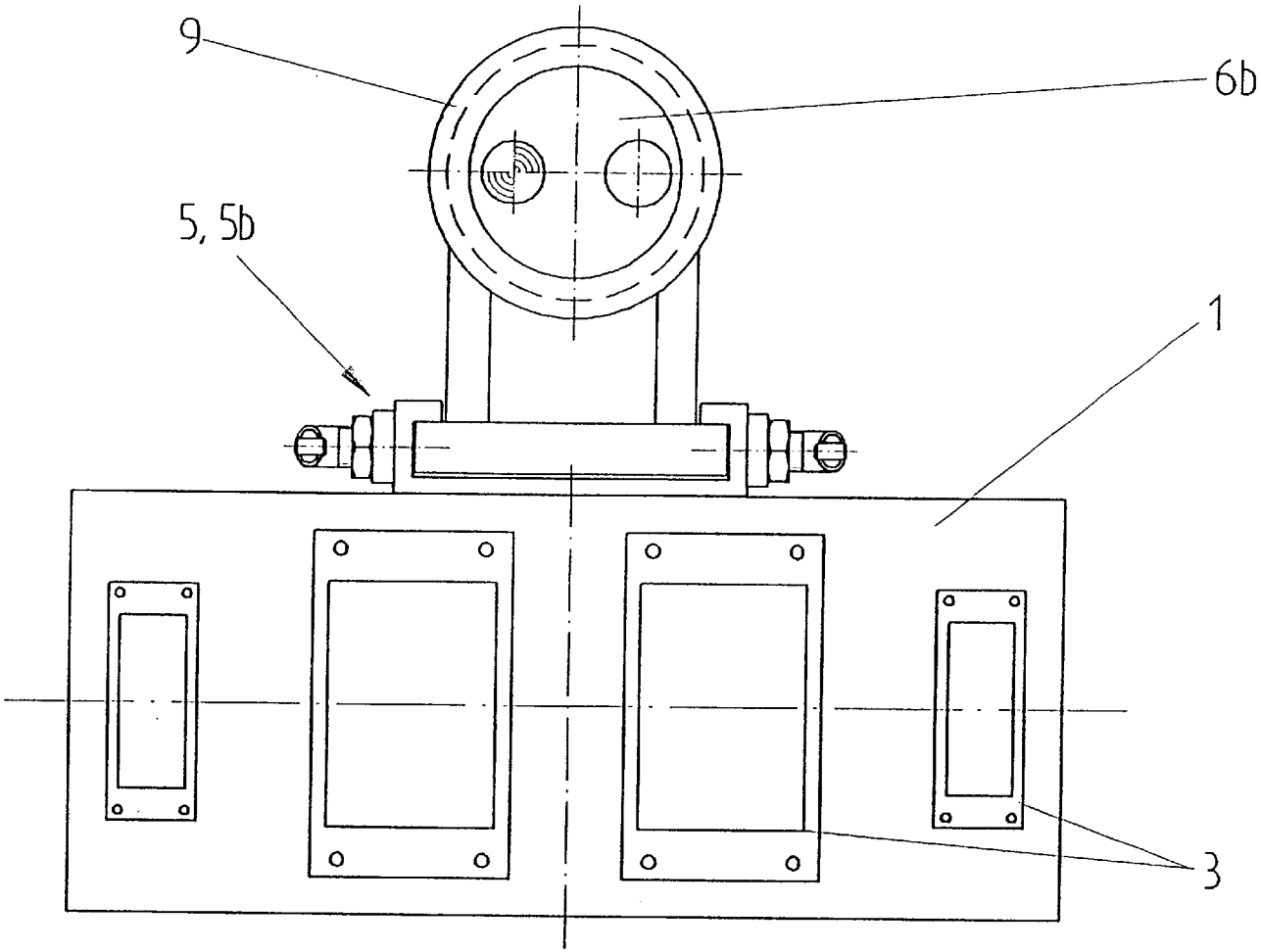
FIG. 3 is the arrangement according to FIG. 2 in the front view of the adapter box with the associated mechanical central buffer coupling.
Figure 4:
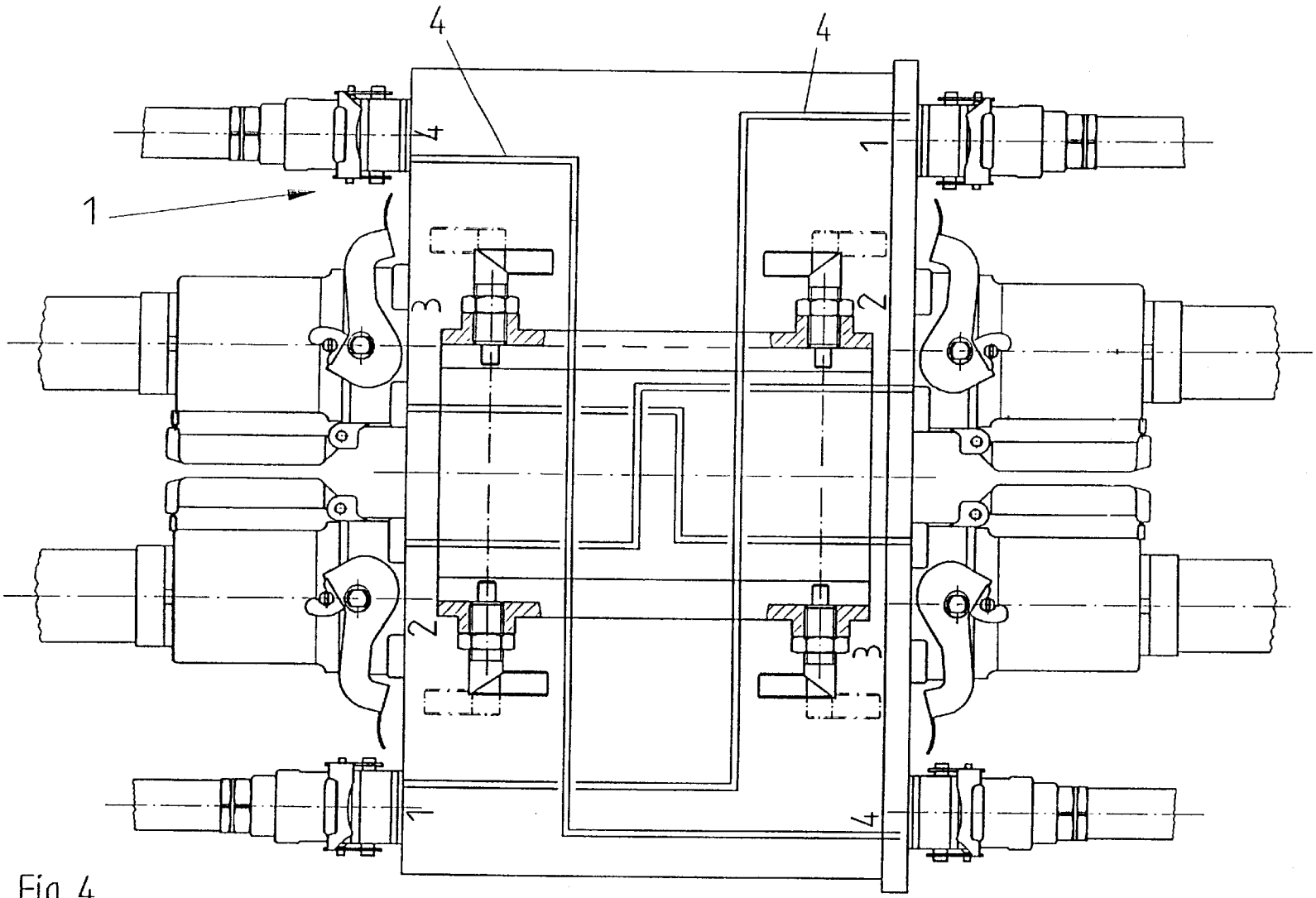
FIG. 4 is a schematic representation of the adapter box as a top view in a partial section with internally crossed connection lines.

Referring to the drawings in particular, a cable coupling for rail-borne vehicles is provided, as shown in detail in FIGS. 1 through 4. The cable coupling for rail-borne vehicles is held longitudinally displaceably on a mechanical central buffer coupling, especially a so-called tight coupling, and has a compact, longitudinally displaceable adapter box 1. The connection of the connection lines 2 from the adapter box 1 to the two rail-borne vehicles to be coupled is performed via confusion-proof plug-and-socket connections 3 or fixed cables with at least one plug-and-socket connection 3 each. The adapter box 1 contains the necessary electrical connection lines 4 for the functionally correct connection of the connection lines 2 with the rail-borne vehicles to be coupled in a correct left-right configuration, arranged crossed within the adapter box 1 such that a connection line 2 arranged to the left of the vertical central longitudinal plane and associated with one end of the adapter box 1 is arranged mirror symmetrically to the right of the vertical central longitudinal plane at the opposite end of the adapter box 1 and a connection line 2 arranged to the right of the vertical central longitudinal plane is correspondingly arranged on the left at the other end of the adapter box 1.

The longitudinal displaceability of the adapter box 1 is brought about by a two-part longitudinal guide (linear guide) 5, which is preferably arranged under the mechanical coupling. The first part 5*a* of the longitudinal guide 5 is associated with the first central buffer coupling 6*a* and the second part 5*b* of the longitudinal guide 5 is associated with the second central buffer coupling 6*b* of the adjacent vehicle to be coupled and is fastened to same.

Both an optional, axial longitudinal displacement of the adapter box 1 on both sides of the point of separation of the coupling and arrangement in the coupling plane, especially under the point of separation of the central buffer couplings 6*a*, 6*b*, is possible due to this design.

To secure the middle position at the point of separation of the coupling and/or the displaced positions on the respective central buffer couplings 6*a*, 6*b*, the adapter box is provided with a locking device 7. This locking may be brought about, e.g., by means of locking pieces or locking elements, which are arranged on the coupling rods of the central buffer couplings 6*a*, 6*b* and which are associated with corresponding opposing pieces on the adapter box 1.

The two parts 5*a*, 5*b* of the longitudinal guide 5 are slightly set back in relation to the vertical plane at the point of separation of the coupling and form a gap 8 in the coupled position of the central buffer couplings 6*a*, 6*b* to prevent damage to the longitudinal guide 5 during an axial shock of the central buffer couplings 6*a*, 6*b*.

For cases of repair or if an adapter box 1 is present at both central buffer couplings 6*a*, 6*b* to be coupled, the adapter box 1 and the longitudinal guide 5 are designed such that the adapter box 1 can be completely removed from the longitudinal guide 5 if necessary.

The coupling process is performed by manually connecting the central buffer couplings 6*a*, 6*b*. In the case of the type of coupling described in the exemplary embodiment, which is also described in the state of the art, the connection is performed by means of a coupling sleeve 9.

An adapter box 1 present at a central buffer coupling, e.g., the coupling 6*b*, is displaced on the longitudinal guide 5 to the point of separation of the coupling and is preferably arranged symmetrically to the point of separation of the coupling. The adapter box 1 is fixed in this position by means of the locking means 7.

The second connection line 2 from the vehicle to be coupled is now connected to the second side of the adapter box 1 by means of the plug-and-socket connection 3. If adapter boxes 1 are present at the coupling point on both central buffer couplings 6*a* and 6*b*, one may be pulled off from the longitudinal guide 5 and be put aside. This remaining connection line 2 is now connected to the remaining adapter box 1.

The uncoupling process takes place analogously in comparable steps in the reverse sequence. Before the mechanical uncoupling, the adapter box 1 is displaced on the longitudinal guide 1 to the mechanical coupling of a vehicle and is locked there. The connection lines 2 to the other vehicle remain on the other vehicle or may be pulled off if a plug-and-socket connection 3 is provided here as well.

The present invention may also be used for cable couplings that also connect optical waveguides, e.g., glass fiber cables, or connect optical waveguides only. This type of line shall also be covered by the terms electric cable coupling, connection line 2 and connection line 4. It is also feasible to connect pneumatic lines of two vehicles via a modified adapter box 1 according to the subject of the present invention.

While specific embodiments of the invention have been shown and described in detail to illustrate the application of the principles of the invention, it will be understood that the invention may be embodied otherwise without departing from such principles.

What is claimed is:

1. A rail-borne vehicle electric cable coupling, the coupling being held longitudinally displaceably on a mechanical central buffer coupling, the electric cable coupling comprising:

a longitudinally displaceable adapter box disposed centrally with respect to the mechanical central buffer, said adapter box including electric connection lines for connecting rail-borne vehicle connection lines of the rail-borne vehicles to be coupled in a functionally correct manner with left-right configuration arranged crossed within said adapter box and with a rail-borne vehicle one end left connection line interface arranged to the left of the vertical central longitudinal plane of the central buffer coupling at one end of said adapter box connected with a corresponding opposite end rail-borne vehicle connection line interface arranged mirror symmetrically to the right of the vertical central longitudinal plane at the opposite end of said adapter box and a one end right rail-borne vehicle connection line interface arranged to the right of the vertical central longitudinal plane of the central buffer coupling at said one end of the adapter box connected with a corresponding opposite rail-borne vehicle connection line interface arranged mirror symmetrically to the left of the vertical central longitudinal plane at the opposite end of said adapter box; and cable connectors, each cable connector having at least one plug-and-socket connection, said cable connectors providing a connection to said rail-borne vehicle connection line interfaces at said one end and connection to said another rail-borne vehicle connection line interface at said opposite end for connection of said rail-borne vehicle connection lines through said adapter box to electrically connect two rail-borne vehicles to be coupled.

2. The electric cable coupling in accordance with claim 1, further comprising:

a two-part longitudinal guide for the longitudinal displaceability of said adapter box, said two-part longitudinal guide having a first part associated with the mechanical central buffer coupling and a second part associated with a second mechanical central buffer coupling of the rail-borne vehicle to be coupled, such that both an optional, axial longitudinal displacement of said adapter box on both sides of the point of separation of the coupling and arrangement in the plane of the point of separation of the central buffer couplings is possible.

3. The electric cable coupling in accordance with claim 2, wherein a middle position of said adapter box at a point of separation of said mechanical central buffer couplings and/or the displaced positions on said longitudinal guide are secured by a locking device.

4. The electric cable coupling in accordance with claim 1, wherein a middle position of said adapter box at a point of separation of said mechanical central buffer couplings is secured by a locking device.

5. The electric cable coupling in accordance with claim 2, wherein said two parts of said longitudinal guide are slightly set back in relation to the vertical plane at the point of separation of the coupling and a gap is formed.

6. The electric cable coupling in accordance with claim 2, wherein said adapter box and said longitudinal guide are designed such that said adapter box can be completely removed from said longitudinal guide if necessary.

7. A rail-borne vehicle coupling arrangement, comprising:

a mechanical central buffer coupling including a first vehicle mechanical coupler and a second vehicle mechanical coupler;

a first vehicle electrical cable with one plug-and-socket connection element;

a second vehicle electrical cable with one plug-and-socket connection element;

a single adapter box connected to said mechanical central buffer coupling above or below said mechanical central buffer and connected to each side of said mechanical central buffer coupling to be longitudinally displaceable with respect to said mechanical central buffer coupling, said adapter box including electric connection lines having a left-right configuration arranged crossed within said adapter box and with a first side plug-and-socket interface connected by said electric connection lines to a second side plug-and-socket interface said first vehicle electrical cable with one plug-and-socket connection element at one end of said adapter box, is connected to said first side plug-and-socket interface and arranged mirror symmetrically at the opposite end of the adapter box said second side plug-and-socket interface is connected to said second vehicle electrical cable with one plug-and-socket connection element.

8. The coupling arrangement in accordance with claim 7, further comprising:

a two-part longitudinal for the longitudinal displaceability of said adapter box, said two-part longitudinal guide having a first part associated with said first mechanical central buffer coupling and a second part associated with said second mechanical central buffer coupling of the rail-borne vehicle to be coupled, such that both an optional, axial longitudinal displacement of said adapter box on both sides of the point of separation of the coupling and arrangement in the plane of the point of separation of the central buffer couplings is possible.

9. The coupling arrangement in accordance with claim 8, wherein a middle position of said adapter box at a point of separation of said mechanical central buffer couplings and/or the displaced positions on said longitudinal guide are secured by a locking device.

10. The coupling arrangement in accordance with claim 7, wherein a middle position of said adapter box at a point of separation of said mechanical central buffer couplings is secured by a locking device.

11. The coupling arrangement in accordance with claim 8, wherein said two parts of said longitudinal guide are slightly set back in relation to the vertical plane at the point of separation of the coupling and a gap is formed.

12. The coupling arrangement in accordance with claim 8, wherein said adapter box and said longitudinal guide are designed such that said adapter box can be completely removed from said longitudinal guide if necessary.

13. A rail-borne vehicle coupling arrangement, comprising:

a mechanical central buffer coupling including a first vehicle mechanical coupler and a second vehicle mechanical coupler;

a first vehicle electrical cable with a first vehicle cable plug-and-socket connection element;

a second vehicle electrical cable with a second vehicle cable plug-and-socket connection element;

a single adapter box having a first mechanical connection to said first vehicle mechanical coupler and having a second mechanical connection to said second mechanical central buffer coupler, said adapter box being mounted longitudinally movable above or below said mechanical central buffer coupling, said adapter box having a first electrical connection interface at a first longitudinal end, said first electrical connection interface being complementary to said first vehicle cable plug-and-socket connection element for connection to said first vehicle cable plug-and-socket connection element and having a second connection interface at a second longitudinal end, said second electrical connection interface being complementary to said first vehicle cable plug-and-socket connection element for connection to second vehicle cable plug-and-socket connection element, said adapter box including electric connection lines having a left-right configuration arranged crossed within said adapter box and connected at said first longitudinal end of said adapter box to said first electrical connection interface and connected at said second longitudinal end of said adapter box to said second electrical connection interface.

14. The coupling arrangement in accordance with claim 13, wherein said first mechanical connection and said second mechanical connection include a longitudinal guide connected to each of said first vehicle mechanical coupler and said second vehicle mechanical coupler for the longitudinal displaceability of said adapter box.

15. The coupling arrangement in accordance with claim 14, wherein said longitudinal guide includes a first longitudinally extending guide part connected to said first vehicle mechanical coupler a second longitudinally extending guide part connected to said second vehicle mechanical coupler and a mechanical connection between said first longitudinally extending guide part and said second longitudinally extending guide part whereby the adapter box may be axially longitudinally displaced to either side of a point of separation of the central buffer couplings is possible.

16. The coupling arrangement in accordance with claim 14, further comprising a locking device for securing said adapter box at a middle position corresponding to a point of separation of said mechanical central buffer couplings and/or a displaced position on said longitudinal guide.

17. The coupling arrangement in accordance with claim 15, wherein said first longitudinally extending guide part and said second longitudinally extending guide part are slightly set back in relation to a vertical plane at a point of separation of the coupling and a connection gap is formed.

18. The coupling arrangement in accordance with claim 13, wherein said adapter box is removable from said longitudinal guide.

* * * * *